US006575566B1

(12) United States Patent
Jeanmaire et al.

(10) Patent No.: US 6,575,566 B1
(45) Date of Patent: Jun. 10, 2003

(54) CONTINUOUS INKJET PRINTHEAD WITH SELECTABLE PRINTING VOLUMES OF INK

(75) Inventors: David L. Jeanmaire, Brockport, NY (US); Gilbert A. Hawkins, Mendon, NY (US); Ravi Sharma, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/246,491

(22) Filed: Sep. 18, 2002

(51) Int. Cl.[7] ..... B41J 2/02; B41J 2/09; B41J 2/105

(52) U.S. Cl. ..... 347/77; 347/82

(58) Field of Search ..... 347/74, 75, 77, 347/82

(56) References Cited

U.S. PATENT DOCUMENTS

| | | | | |
|---|---|---|---|---|
| 1,941,001 A | | 12/1933 | Hansell | |
| 3,373,473 A | | 3/1968 | Sweet et al. | |
| 3,416,153 A | | 12/1968 | Hertz et al. | |
| 3,709,432 A | | 1/1973 | Robertson | |
| 3,878,519 A | | 4/1975 | Eaton | |
| 4,068,241 A | * | 1/1978 | Yamada | 347/77 |
| 4,097,872 A | * | 6/1978 | Giordano et al. | 347/75 |
| 4,190,844 A | | 2/1980 | Taylor | |
| 4,346,387 A | | 8/1982 | Hertz | |
| 4,638,328 A | | 1/1987 | Drake et al. | |
| 4,638,382 A | | 1/1987 | Sochor | |
| 5,461,407 A | * | 10/1995 | Robertson et al. | 347/82 |
| 6,079,821 A | | 6/2000 | Chwalek et al. | |

FOREIGN PATENT DOCUMENTS

EP 1219430 A1 * 7/2002

* cited by examiner

*Primary Examiner*—Anh T. N. Vo
(74) *Attorney, Agent, or Firm*—Stephen H. Shaw

(57) ABSTRACT

An inkjet printhead, that includes a plurality of nozzle bores from which streams of ink droplets having selectable first and second volumes are emitted; a droplet deflector for deflecting the ink droplets having first and second volumes into first and second paths respectively, the droplet deflector producing a corresponding plurality of physically separate streams of gas, each stream of gas directed on a corresponding one of the streams of ink droplets; and an ink gutter positioned to catch the ink droplets moving along one of the first or second paths. In addition to a method for selectively controlling the ink droplets with the aforementioned inkjet printhead.

29 Claims, 11 Drawing Sheets

CONTINUOUS INKJET PRINTHEAD WITH SELECTABLE PRINTING VOLUMES OF INK

CROSS REFERENCE TO RELATED APPLICATIONS

Reference is made to commonly assigned, co-pending U.S. patent application Ser. No. 09/751,232, filed Dec. 28, 2000, titled "A Continuous Ink-Jet Printing Method And Apparatus," by D. L. Jeanmaire, et al., U.S. patent application Ser. No. 09/750,946, filed Dec. 28, 2000, titled "Printhead Having Gas Flow Ink Droplet Separation And Method Of Diverging Ink Droplets," by D. L. Jeanmaire, et al., and U.S. patent applications Ser. No. 10/100,376, filed Mar. 18, 2002, titled "A Continuous Ink Jet Printing Apparatus With Improved Drop Placement," by D. L. Jeanmaire.

FIELD OF THE INVENTION

This invention relates generally to the field of digitally controlled printing devices, and in particular to continuous inkjet printers wherein a liquid ink stream breaks into droplets, some of which are selectively deflected.

BACKGROUND OF THE INVENTION

Continuous inkjet printing, uses a pressurized ink source that produces a continuous stream of ink droplets. Conventional continuous inkjet printers utilize electrostatic charging devices that are placed close to the point where a filament of ink breaks into individual ink droplets. The ink droplets are electrically charged and then directed to an appropriate location by deflection electrodes. When no printing is desired, the ink droplets are directed into an ink-capturing mechanism (often referred to as a catcher, interceptor, or gutter). When printing is desired, the ink droplets are directed to strike a print media.

Typically, continuous inkjet printing devices are faster than drop-on-demand devices and produce higher quality printed images and graphics. However, each color printed requires an individual droplet formation, deflection, and capturing system.

U.S. Pat. No. 1,941,001, issued to Hansell on Dec. 26, 1933, and U.S. Pat. No. 3,373,437 issued to Sweet et al. on Mar. 12, 1968, each disclose an array of continuous inkjet nozzles wherein ink droplets to be printed are selectively charged and deflected towards the recording medium. This technique is known as binary deflection continuous inkjet.

U.S. Pat. No. 3,416,153, issued to Hertz et al. on Dec. 10, 1968, discloses a method of achieving variable optical density of printed spots in continuous inkjet printing using the electrostatic dispersion of a charged droplet stream to modulate the number of droplets which pass through a small aperture.

U.S. Pat. No. 3,878,519, issued to Eaton on Apr. 15, 1975, discloses a method and apparatus for synchronizing droplet formation in a liquid stream using electrostatic deflection by a charging tunnel and deflection plates.

U.S. Pat. No. 4,346,387, issued to Hertz on Aug. 24, 1982, discloses a method and apparatus for controlling the electric charge on droplets formed by the breaking up of a pressurized liquid stream at a droplet formation point located within the electric field having an electric potential gradient. Droplet formation is effected at a point in the field corresponding to the desired predetermined charge to be placed on the droplets at the point of their formation. In addition to charging tunnels, deflection plates are used to actually deflect droplets.

U.S. Pat. No. 4,638,328, issued to Drake et al. on Jan. 20, 1987, discloses a continuous inkjet printhead that utilizes constant thermal pulses to agitate ink streams admitted through a plurality of nozzles in order to break up the ink streams into droplets at a fixed distance from the nozzles. At this point, the droplets are individually charged by a charging electrode, and subsequently deflected using deflection plates positioned in the droplet path.

As conventional continuous inkjet printers utilize electrostatic charging devices and deflector plates, they require many components and large spatial volumes to operate. This results in continuous inkjet printheads and printers that are complicated, have high energy requirements, are difficult to manufacture, and are difficult to control.

U.S. Pat. No. 3,709,432, issued to Robertson on Jan. 9, 1973, discloses a method and apparatus for stimulating a filament of working fluid causing the working fluid to break up into uniform spaced ink droplets through the use of transducers. The lengths of the filaments, before they break up into ink droplets, are regulated by controlling the stimulation energy supplied to the transducers. High amplitude stimulation causes short filaments and low amplitude stimulations causes longer filaments. A flow of air is generated across the paths of the fluid at a point intermediate to the ends of the long and short filaments. The air flow affects the trajectories of the filaments before they break up into droplets, more than it affects the trajectories of the ink droplets themselves. By controlling the lengths of the filaments, the trajectories of the ink droplets can be controlled, or switched from one path to another. As such, some ink droplets may be directed into a catcher while allowing other ink droplets to be applied to a receiving member.

While this method does not rely on electrostatic means to affect the trajectory of droplets, it does rely on the precise control of the break up points of the filaments and the placement of the air flow intermediate to these break up points. Such a system is difficult to control and to manufacture. Furthermore, the physical separation or amount of discrimination between the two droplet paths is small, further adding to the difficulty of control and manufacture.

U.S. Pat. No. 4,190,844, issued to Taylor on Feb. 26, 1980, discloses a continuous inkjet printer having a first pneumatic deflector for deflecting non-printed ink droplets to a catcher and a second pneumatic deflector for oscillating printed ink droplets. A printhead supplies a filament of working fluid that breaks into individual ink droplets. The ink droplets are then selectively deflected by a first pneumatic deflector, a second pneumatic deflector, or both. The first pneumatic deflector is an "ON/OFF" type having a diaphragm that either opens or closes a nozzle depending on one of two distinct electrical signals received from a central control unit. This determines whether the ink droplet is printed or not printed. The second pneumatic deflector is a continuous type having a diaphragm that varies the amount that a nozzle is open, depending on a varying electrical signal received by the central control unit. This second pneumatic deflector oscillates printed ink droplets so that characters may be printed one character at a time. If only the first pneumatic deflector is used, characters are created one line at a time, as a result of repeated traverses of the printhead and ink build up.

While this method does not rely on electrostatic means to affect the trajectory of droplets, it does rely on the precise control and timing of the first ("ON/OFF") pneumatic deflector to create printed and non-printed ink droplets. Such a system is difficult to manufacture and accurately control, resulting in at least a similar ink droplet build up as discussed above. Furthermore, the physical separation or amount of discrimination between the two droplet paths is erratic, due to the precise timing requirements, therefore, increasing the difficulty of controlling printed and non-printed ink droplets and resulting in poor ink droplet trajectory control.

Additionally, using two pneumatic deflectors complicates construction of the printhead and requires more components. The additional components and complicated structure require large spatial volumes between the printhead and the media, thereby, increasing the ink droplet trajectory distance. Increasing the distance of the droplet trajectory decreases droplet placement accuracy and affects the print image quality. Again, there is a need to minimize the distance that the droplet must travel before striking the print media in order to insure high quality images.

U.S. Pat. No. 6,079,821, issued to Chwalek et al. on Jun. 27, 2000, discloses a continuous inkjet printer that uses actuation of asymmetric heaters to create individual ink droplets from a filament of working fluid and to deflect those ink droplets. A printhead includes a pressurized ink source and an asymmetric heater operable to form printed ink droplets and non-printed ink droplets. Printed ink droplets flow along a printed ink droplet path ultimately striking a receiving medium, while non-printed ink droplets flow along a non-printed ink droplet path ultimately striking a catcher surface. Non-printed ink droplets are recycled or disposed of through an ink removal channel formed in the catcher. While the inkjet printer disclosed in Chwalek et al. works extremely well for its intended purpose, it is best adapted for use with inks that have a large viscosity change with temperature.

Each of the above-described inkjet printing systems has advantages and disadvantages. However, printheads which are low-power and low-voltage in operation will be advantaged in the marketplace, especially in page-width arrays. U.S. patent application Ser. No. 09/750,946, filed Dec. 28, 2000 by D. L. Jeanmaire et al. and U.S. patent application Ser. No. 09/751,232, filed Dec. 28, 2000 by D. L. Jeanmaire et al., disclose continuous inkjet printing wherein nozzle heaters are selectively actuated at a plurality of frequencies to create the stream of ink droplets having the plurality of volumes. A gas stream provides a force separating droplets into printing and non-printing paths according to droplet volume. While this process consumes little power, and is suitable for printing with a wide range of inks, when implemented in a page-width array, a correspondingly wide laminar gas flow is required. The wide laminar gas flow is often difficult to obtain due to the mechanical tolerances involved in the gas flow plenum, with the result that the gas velocity varies somewhat across the printhead, and turbulent flow regions may exist. Non-uniform gas flow has an adverse effect upon droplet placement on the print medium, and therefore image quality is compromised.

It can be seen that there is a need to improve gas-flow uniformity in the design of large nozzle-count printheads such as those used in inkjet printers having page-width arrays.

SUMMARY OF THE INVENTION

The above need is met according to the present invention by providing an inkjet printhead, that includes a plurality of nozzle bores from which streams of ink droplets having selectable first and second volumes are emitted; a droplet deflector for deflecting the ink droplets having first and second volumes into first and second paths respectively, the droplet deflector producing a corresponding plurality of physically separate streams of gas, each stream of gas directed on a corresponding one of the streams of ink droplets; and an ink gutter positioned to catch the ink droplets moving along one of the first or second paths.

Additionally, the present invention provides a method for selectively controlling ink droplets in an inkjet printhead, which includes the steps of: emitting streams of ink droplets having selectable first and second volumes; deflecting the ink droplets having first and second volumes into first and second paths, respectively; providing a plurality of separate streams of gas; directing each of the plurality of separate streams of gas at a corresponding one of the streams of ink droplets to move the streams of ink droplets along the first and second paths; and catching the ink droplets moving along one of the first or second paths in an ink gutter.

BRIEF DESCRIPTION OF THE DRAWINGS

Other features and advantages of the present invention will become apparent from the following description of the preferred embodiments of the invention, and the accompanying drawings, wherein.

DETAILED DESCRIPTION OF THE INVENTION

The present invention will be directed in particular to elements forming part of, or cooperating more directly with the present invention. It is to be understood that elements not specifically shown or described may take various forms that are well known to those skilled in the art.

Figure 1:
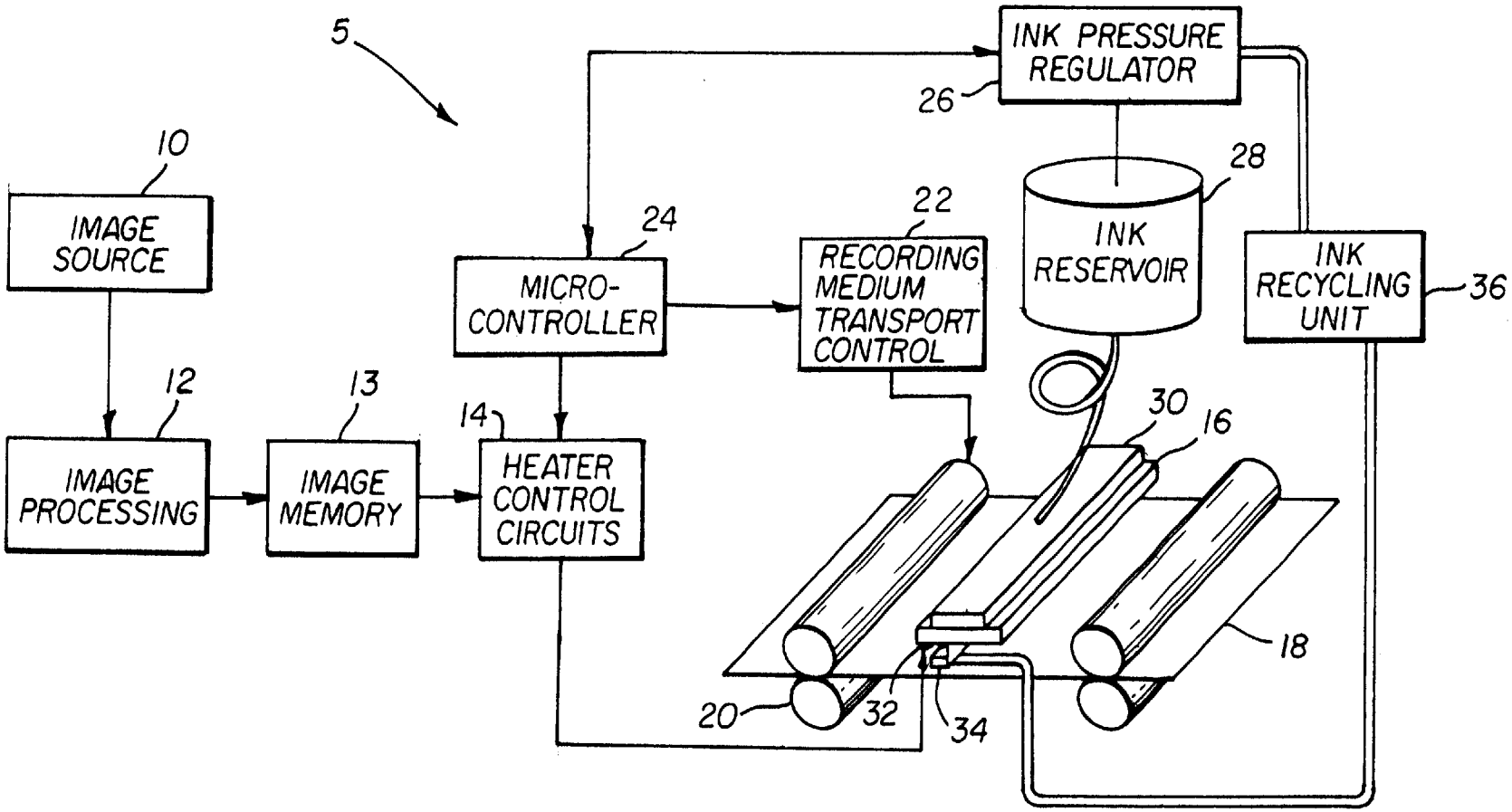
FIG. 1 (Prior Art)
FIG. 1 is a prior art schematic diagram of a printing apparatus incorporating a page-width printhead.

Referring to FIG. 1, a prior art continuous inkjet printer system 5 is shown. The continuous inkjet printer system 5 includes an image source 10 such as a scanner or computer which provides raster image data, outline image data in the form of a page description language, or other forms of digital image data. This digital image data is converted to half-toned bitmap image data by an image processing unit 12, which also stores the digital image data in image memory 13. A heater control circuit 14 reads data from the image memory 13 and applies electrical pulses to a heater 32 that is part of a printhead 16. These pulses are applied at an appropriate time, so that droplets formed from a continuous inkjet stream will print spots on a recording medium 18, in the appropriate position, designated by the data in the image memory 13. The printhead 16, shown in FIG. 1, is commonly referred to as a page-width printhead.

Recording medium 18 is moved relative to printhead 16 by a recording medium transport system 20 which is electronically controlled by a recording medium transport control system 22, and which in turn is controlled by a micro-controller 24. The recording medium transport system 20 shown in FIG. 1 is a schematic only, and many different mechanical configurations are possible. For example, a transfer roller could be used as recording medium transport system 20 to facilitate transfer of the ink droplets to recording medium 18. Such transfer roller technology is well known in the art. In the case of page-width printheads 16, it is most convenient to move recording medium 18 past a stationary printhead 16.

Ink is contained in an ink reservoir 28 under pressure. In the nonprinting state, continuous inkjet droplet streams are unable to reach recording medium 18 due to an ink gutter 34 that blocks the stream and which may allow a portion of the ink to be recycled by an ink recycling unit 36. The ink recycling unit 36 reconditions the ink and feeds it back to ink reservoir 28. Such ink recycling units 36 are well known in the art. The ink pressure suitable for optimal operation will depend on a number of factors, including geometry and thermal properties of the nozzle bores 42 (shown in FIG. 2) and thermal properties of the ink. A constant ink pressure can be achieved by applying pressure to ink reservoir 28 under the control of ink pressure regulator 26.

Continuous inkjet printers system 5 can incorporate additional ink reservoirs 28 in order to facilitate color printing. When operated in this fashion, ink collected by ink gutter 34 is typically collected and disposed.

The ink is distributed to the back surface of printhead 16 by an ink channel 30. The ink, preferably, flows through slots and/or holes etched through a silicon substrate of printhead 16 to its front surface where a plurality of nozzles and heaters are situated. With printhead 16 fabricated from silicon, it is possible to integrate heater control circuits 14 with the printhead 16. Printhead 16 can be formed using known semiconductor fabrication techniques (including CMOS circuit fabrication techniques, micro-electro mechanical structure MEMS fabrication techniques, etc.). Printhead 16 can also be formed from semiconductor materials other than silicon, for example, glass, ceramic, or plastic.

Figure 2:
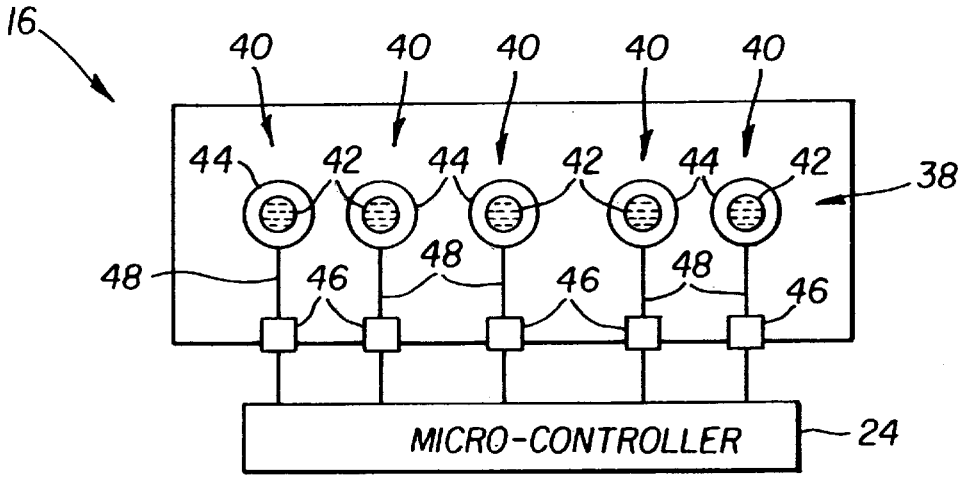
FIG. 2 is a top view of a printhead having a droplet forming mechanism incorporating the present invention.

Referring to FIG. 2, printhead 16 is shown in more detail. Printhead 16 includes a droplet forming mechanism 38. Droplet forming mechanism 38 can include a plurality of heaters 40 positioned on printhead 16 around a plurality of nozzle bores 42 formed in printhead 16. Although each heater 40 may be radially disposed away from an edge of a corresponding nozzle bore 42, heaters 40 are, preferably, disposed close to corresponding nozzle bores 42 in a concentric manner. Typically, heaters 40 are formed in a substantially circular or ring shape. However, heaters 40 can be formed in other shapes. Conventionally, each heater 40 has a resistive heating element 44 electrically connected to a contact pad 46 via a conductor 48. A passivation layer (not shown), formed from silicon nitride is normally placed over the resistive heating elements 44 and conductors 48 to provide electrical insulation relative to the ink. Contact pads 46 and conductors 48 form a portion of the heater control circuits 14 which are connected to micro-controller 24. Alternatively, other types of heaters can be used with similar results.

Figure 3:
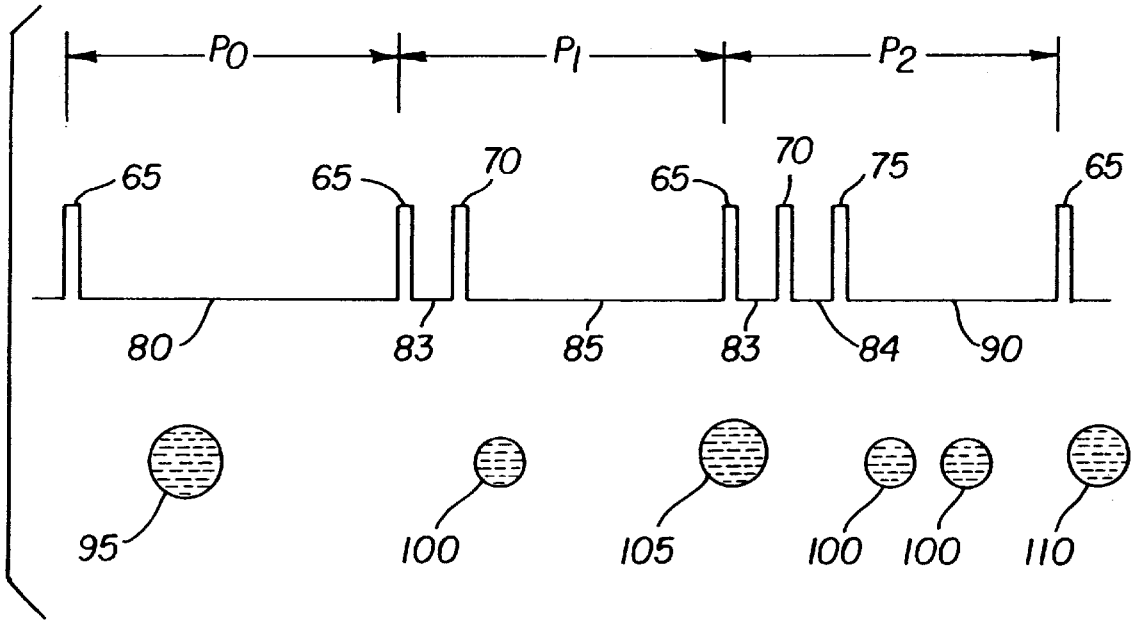
FIG. 3 is a schematic example of the electrical activation waveform provided by the present invention.

Heaters 40 are selectively actuated to from droplets. The volume of the formed droplets is a function of the rate of ink flow through the nozzle bore 42 and the rate of heater activation, but is independent of the amount of energy dissipated in the heaters. FIG. 3 is a schematic example of the electrical activation waveform provided by micro-controller 24 to heaters 40. In general, rapid pulsing of heaters 40 forms small ink droplets, while slower pulsing creates larger droplets. In the example presented herein, small ink droplets are to be used for marking the recording medium 18, while larger, non-printable droplets are captured for ink recycling.

Consequently, multiple droplets per nozzle per image pixel are created. Periods $P_0$, $P_1$, $P_2$, etc. are the times associated with the printing of associated image pixels, the subscripts indicate the number of printing droplets created during the pixel time. The schematic illustration shows the droplets that are created as a result of the application of the various waveforms. A maximum of two small printing droplets is shown for simplicity of illustration, however, the concept can be readily extended to permit a higher maximum count of printing droplets.

In the droplet formation for each image pixel, a non-printable large droplet 95, 105, or 110 is always created, in addition to a select number of small, printable droplets 100. The waveform of activation for heater 40, for every image pixel, begins with an electrical pulse time 65. The further (optional) activation of heater 40, after delay time 83, with an electrical pulse 70, is conducted in accordance with image data, wherein at least one printable droplet 100 is required as shown for interval $P_1$. For cases where the image data requires that still another printable droplet 100 be created as in interval $P_2$, heater 40 is again activated, after delay 84, with a pulse 75. Heater activation. electrical pulse times 65, 70, and 75 are substantially similar, as are all delay times 83 and 84. Delay times 80, 85, and 90 are the remaining times after pulsing is over in a pixel time interval P, and the start of the next image pixel. All small printable droplets 100 are the same volume. However, the volume of the larger, non-printable droplets 95, 105 and 110 varies depending on the number of small printable droplets 100 created in the preceding pixel time interval P as the creation of small droplets takes mass away from large droplets during the pixel time interval P. The delay time 90 is preferably chosen to be significantly larger than the delay times 83, 84, so that the volume ratio of large non-printable-droplets 110 to small printable droplets 100 is a factor of 4 or greater.

Figure 4:
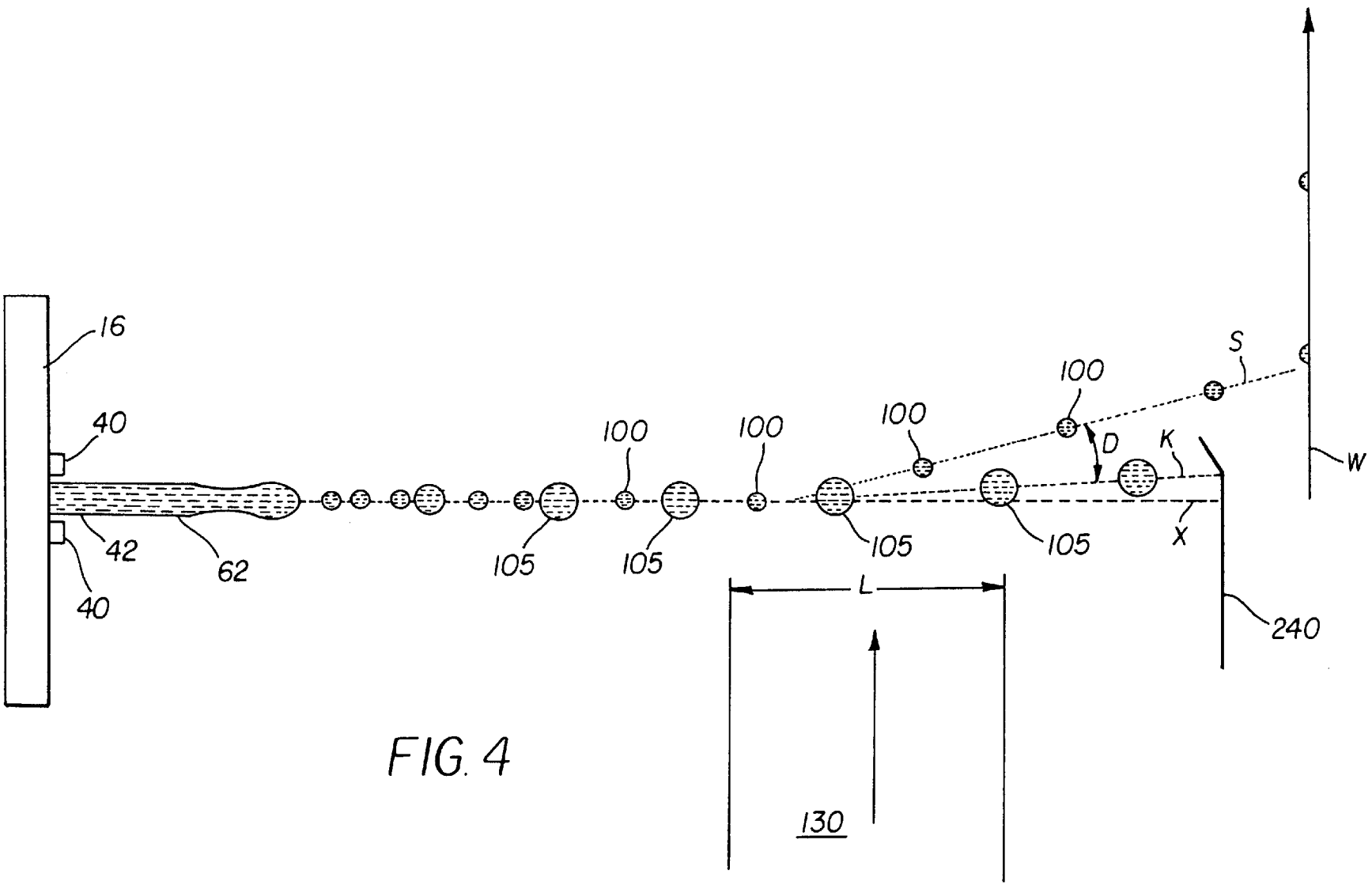
FIG. 4 is a schematic example of the operation of an inkjet printhead according to the present invention.

FIG. 4 is a schematic example of the operation of printhead 16 in a manner that provides one printing droplet per pixel. Printhead 16 is coupled with a gas-flow discriminator 130 which separates droplets into printing or non-printing paths, according to droplet volume. Ink is ejected through nozzle bores 42 in printhead 16, thus creating a filament of working fluid 62 that moves substantially perpendicular to printhead 16 along axis X. Heaters 40 are selectively activated at various frequencies according to image data, causing filaments of working fluid 62 to break up into streams of individual ink droplets. Coalescencing of droplets often occurs when forming non-printable droplets 105. The gas flow discriminator 130 is provided by a gas flowing at a non-zero angle with respect to axis X. As one example, the gas flow may be perpendicular to axis X. Gas flow discriminator 130 acts over distance L, and as a gaseous force from gas flow discriminator 130 interacts with the stream of ink droplets, the individual ink droplets separate, depending on individual volume and mass. The gas flow rate can be adjusted to provide sufficient deviation D between the small droplet path S and the large droplet paths K, thereby permitting small printable droplets 100 to strike print media W, while large non-printable droplets 105 are captured by an ink guttering structure 240.

Figure 5:
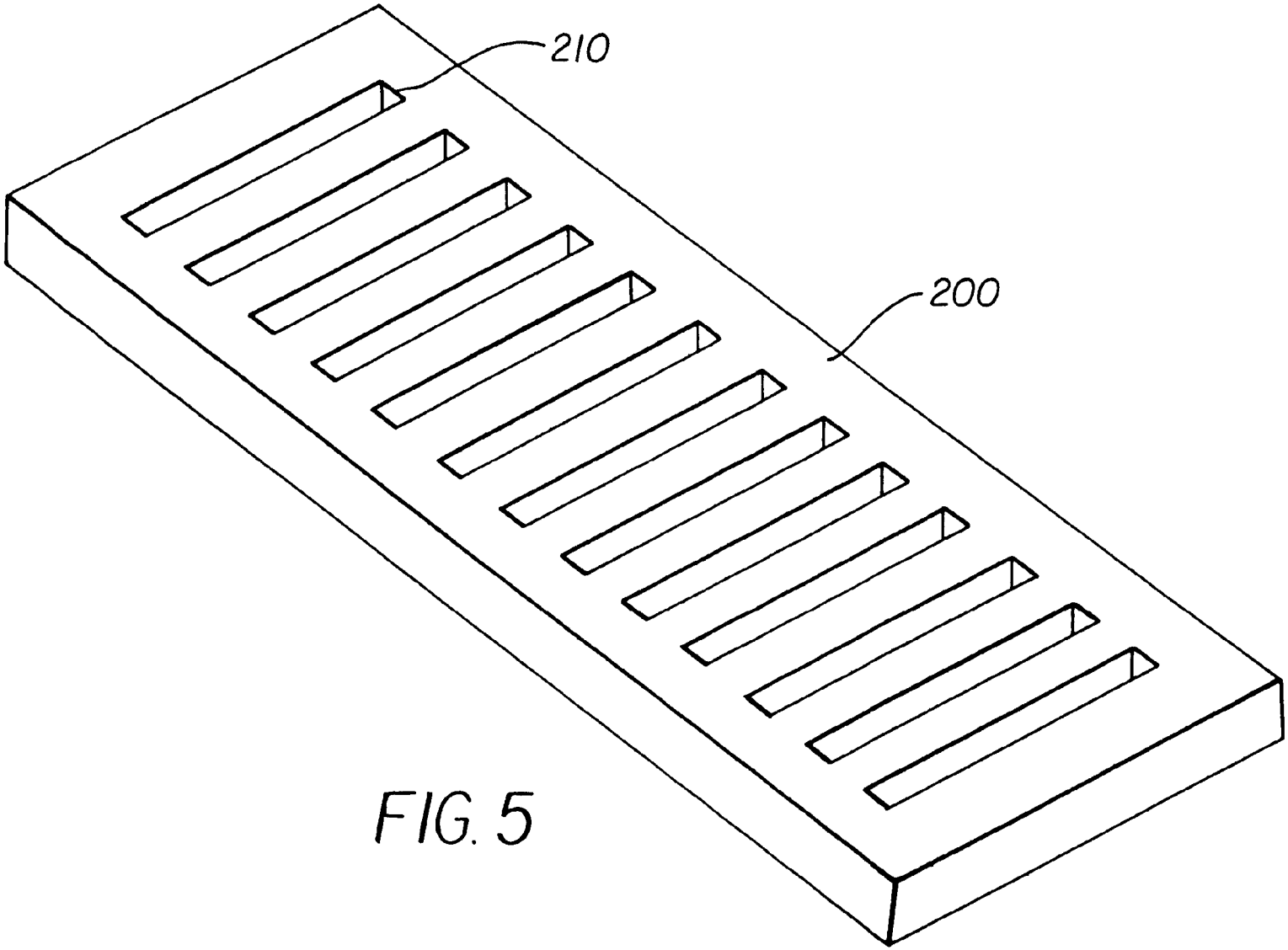
FIG. 5 is an isometric view of a gas discriminator according to the present invention.

In one embodiment of the present invention, a gas flow discriminator 130 is shaped by a plenum (not shown) fitted with an exit aperture plate 200 or cap as shown in FIG. 5. This plate is a structure with holes or slits 210 that serve to channel gas flow into individual jets, where the pitch of the openings is essentially the same as the nozzle pitch on the printhead. In this manner, each ink droplet stream has an associated gas flow stream. Exit aperture plate 200 is formed from silicon, using known semiconductor fabrication techniques (such as, micro-electro mechanical structure (MEMS) fabrication techniques, etc.). However, exit aperture plate 200 may be formed from any materials (e.g. plastics, ceramics, metal, etc.) using any fabrication techniques conventionally known in the art. Due to the fact that the total area of exit slits 210 is less than the cross-sectional area of the plenum, a pressure droplet is created across the exit aperture plate 200. This serves to increase the uniformity in the velocity of gas flow across the exit aperture plate 200 from slit-to-slit, as well as reduce gas-flow turbulence.

Figure 6:
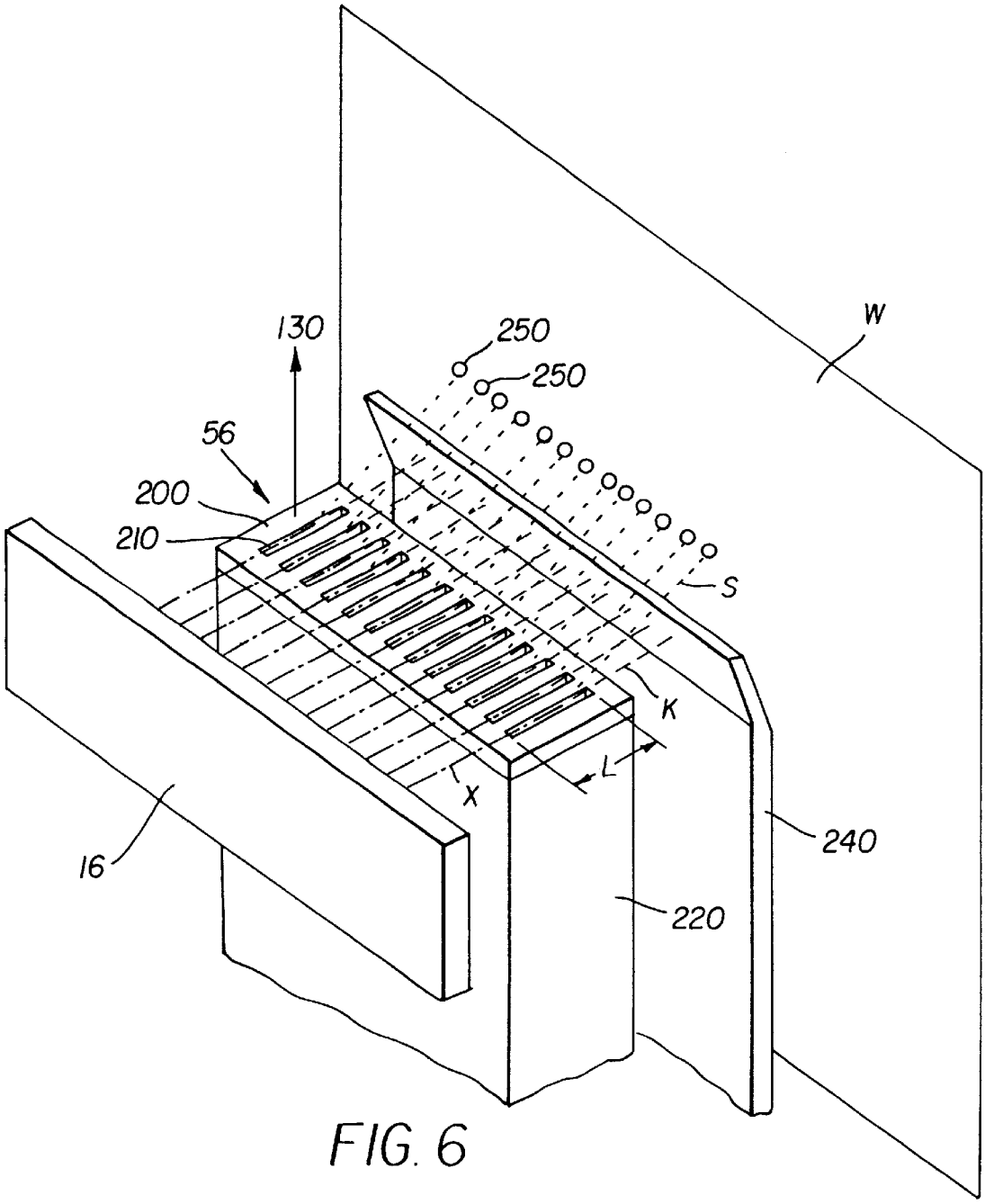
FIG. 6 is a schematic view showing droplet streams ejected from a printhead incorporating the present invention.

Referring now to FIG. 6, which is a schematic view incorporating an embodiment of the current invention, droplet streams are ejected from printhead 16. As discussed earlier with reference to FIG. 3, but not shown herein, droplet forming mechanism 38 is actuated such that droplets of ink having a plurality of volumes 95, 100, 105 and 110 (as shown in FIG. 3) traveling along paths X (FIG. 6) are formed. A gas flow discriminator 130 supplied from a droplet deflector system 56, including a gas flow source 58 (not shown), plenum 220, and exit aperture plate 200, is continuously applied to droplets 95, 100, 105 and 110 over an interaction distance L. Because droplets 95, 105 and 110 have a larger volume (in addition to more momentum and greater mass) than droplets 100, droplets 100 deviate from path X and begin traveling along path S; while droplets 95, 105 and 110 remain traveling, substantially, along path X or deviate slightly from path X and begin traveling along path K. With appropriate adjustment of gas flow discriminator 130, and appropriate positioning of the ink guttering structure 240, droplets 100 contact print media W at location 250, while droplets 95, 105 and 110 are collected by ink guttering structure 240.

Figure 7A:
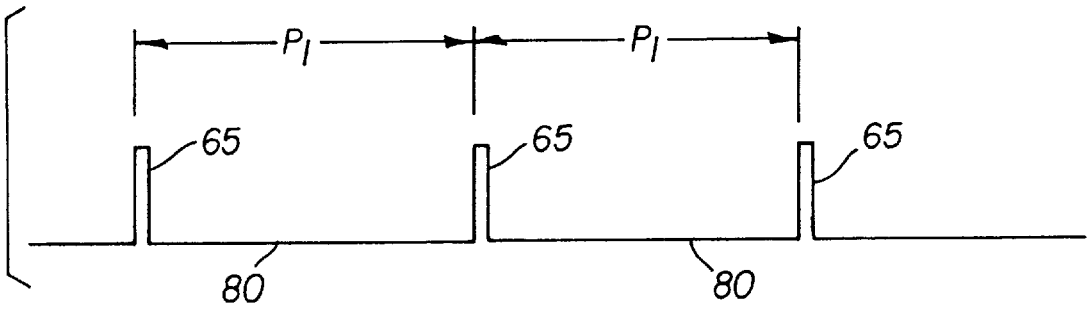
FIGS. 7*a*–7*f* are schematic representations of the electrical waveform of a heater in the present invention.
Figure 7B:
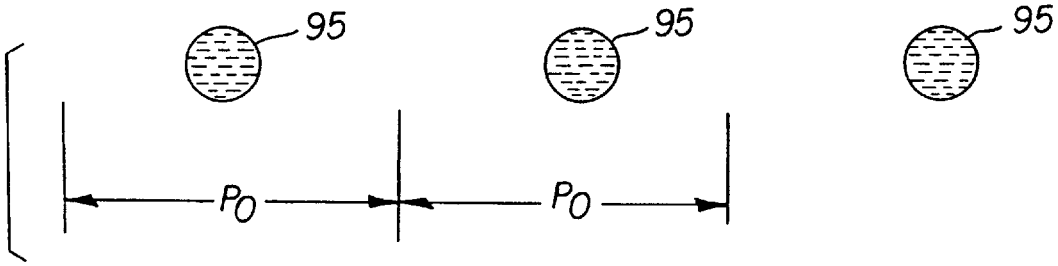
Figure 7C:
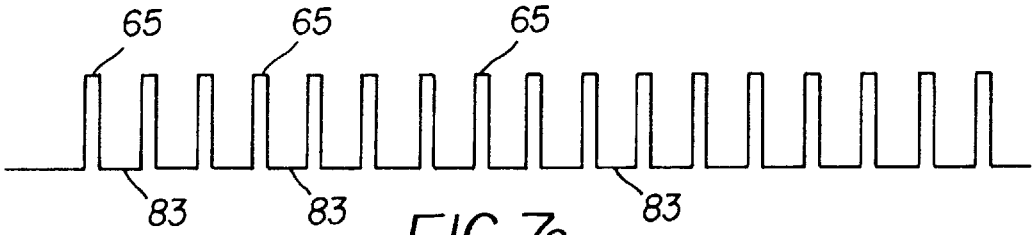
Figure 7D:
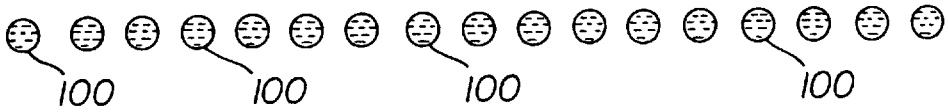

In another embodiment of the current invention, the principle of the printing operation is reversed, where the larger droplets are used for printing, and the smaller droplets recycled. An example of this mode is presented here. In this example, only one printing droplet is provided for per image pixel, thus there are two states of heater 40 actuation, printing or non-printing. The electrical waveform of heater 40 actuation for the printing case is presented schematically as FIG. 7*a*. The individual large non-printable droplets 95 resulting from the jetting of ink from nozzle bores 42, in combination with this electrical pulse time 65 and delay times 80, are shown schematically as FIG. 7*b*. The electrical waveform of heater 40 activation for the non-printing case is given schematically as FIG. 7*c*. Electrical pulse time 65 duration remains unchanged from FIG. 7*a*, however, time delay 83 between activation pulses is a factor of 4 and shorter than delay time 80. The small droplets 100, as diagrammed in FIG. 7*d*, are the result of the activation of heater 40 with this non-printing waveform.

Figure 7E:
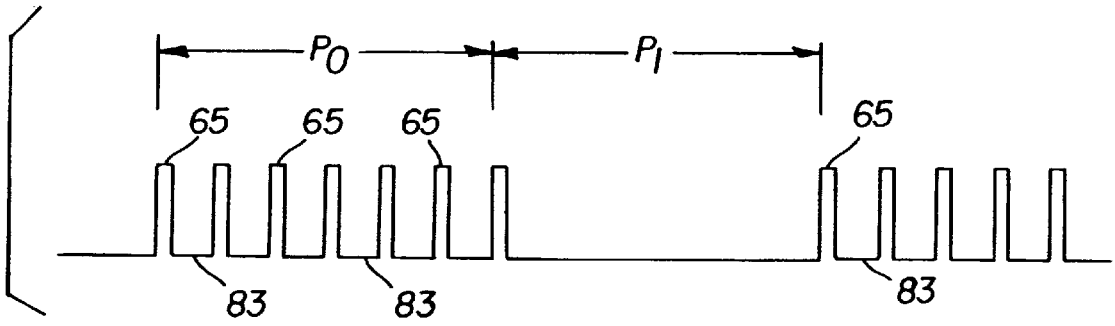
Figure 7F:
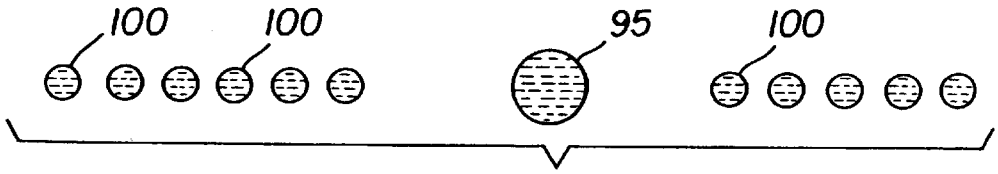
Figure 8:
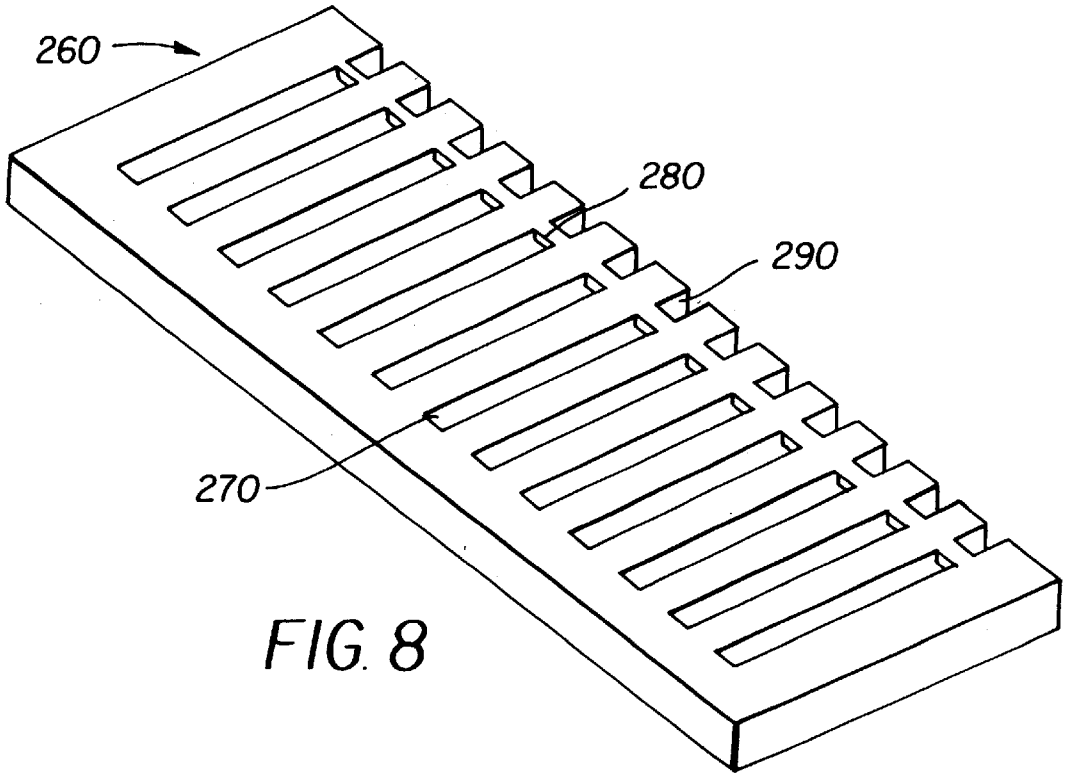
FIG. 8 is an isometric view of an aperture plate according to the present invention.

FIG. 7*e* is a schematic representation of the electrical waveform of heater 40's activation for mixed image data. A transition from the non-printing state to the printing state, and back again to the non-printing state is shown. A schematic representation is shown of the resultant formed droplet stream, FIG. 7*f*. Heater 40's activation may be independently controlled, based on a required ink color, and ejecting the desired ink through corresponding nozzle bores 42; or moving printhead 16 relative to a print media W. In one embodiment of this invention, the function of droplet deflection is combined physically with that of ink guttering. This combined assembly allows for a more compact physical implementation, and thus the printhead 16 can be closer to the print media W for improved droplet placement. Referring to FIG. 8, in this configuration, vacuum aperture plate 260 consists of holes or slots 270 to permit the entry of gas into a plenum (not shown). The air pressure in the plenum is below ambient, such that air flows from the external environment into vacuum aperture plate 260. Slots 270 are spaced at the same pitch as the nozzles on printhead 16. Vacuum aperture plate 260 also contains guttering ribs 280 and relief channel 290 whose functions will become more clear from the following discussion.

Figure 9:
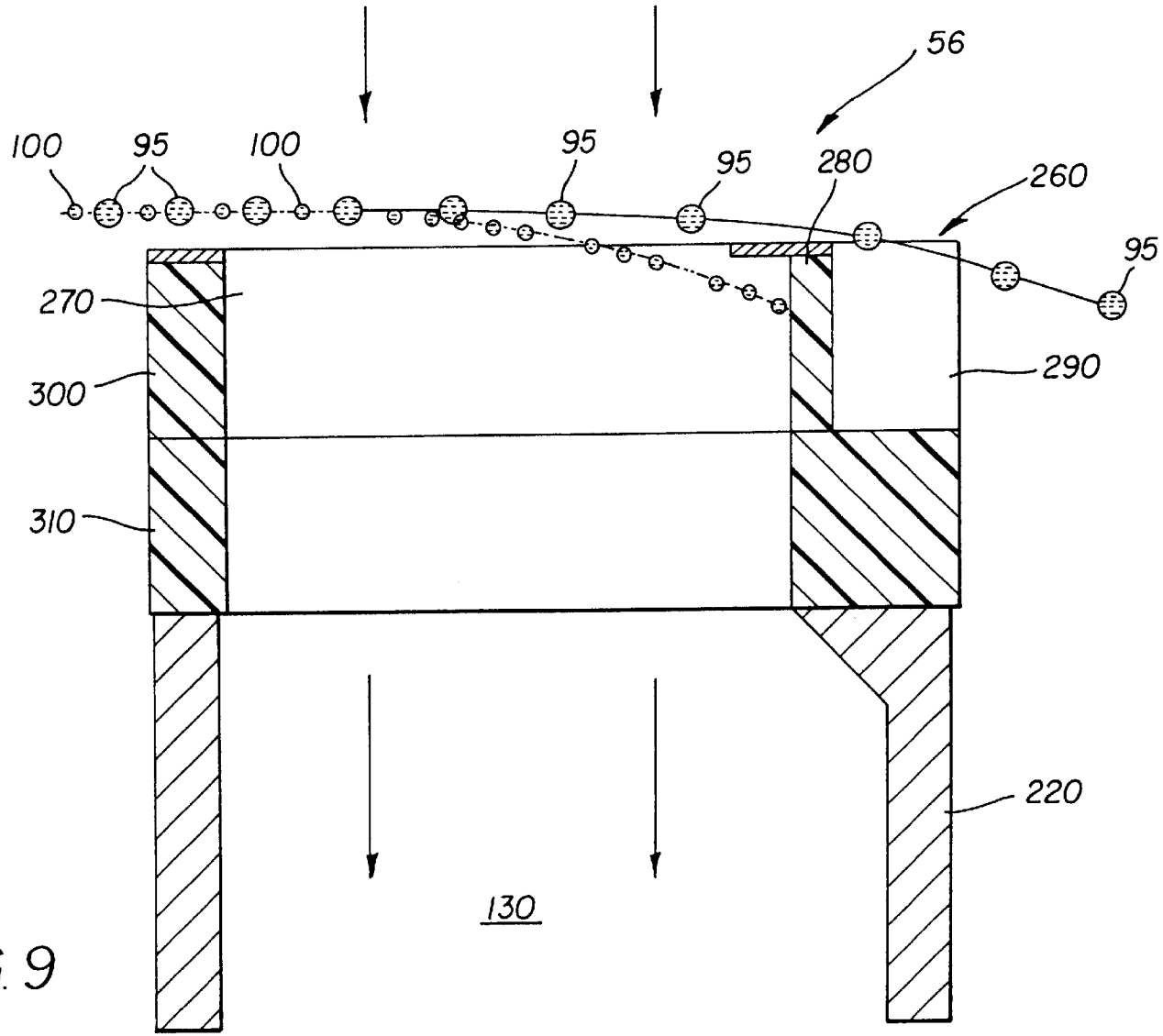
FIG. 9 is a cross-sectional view of the aperture plate in FIG. 8.

FIG. 9 is an end-on cross-sectional view of vacuum aperture plate 260 taken through the center of a slot 270. As an example here, vacuum aperture plate 260 is fabricated from silicon, and was constructed by bonding wafers 300 and 310 together, after etching steps were completed. Vacuum aperture plate 260 is then adhesively joined to the end of plenum 220. Droplet streams ejected from printhead 16 consisting of large non-printable droplets 95 and small printable droplets 100 initially pass over droplet deflection system 56 and interact with gas flow discriminator 130. Small printable droplets 100 are deflected into slot 270 and strike guttering rib 280 before being drawn down into plenum 220. Guttering rib 280 has a top plate which overhangs slot 270 to prevent ink from splattering over guttering rib 280 and down the outside of droplet deflection system 56. Large non-printable droplets 95 pass over guttering rib 280 and are allowed to strike print media W. Relief channel 290 provides clearance for large non-printable droplets 95, so that they do not strike the top of vacuum aperture plate 260.

Figure 10:
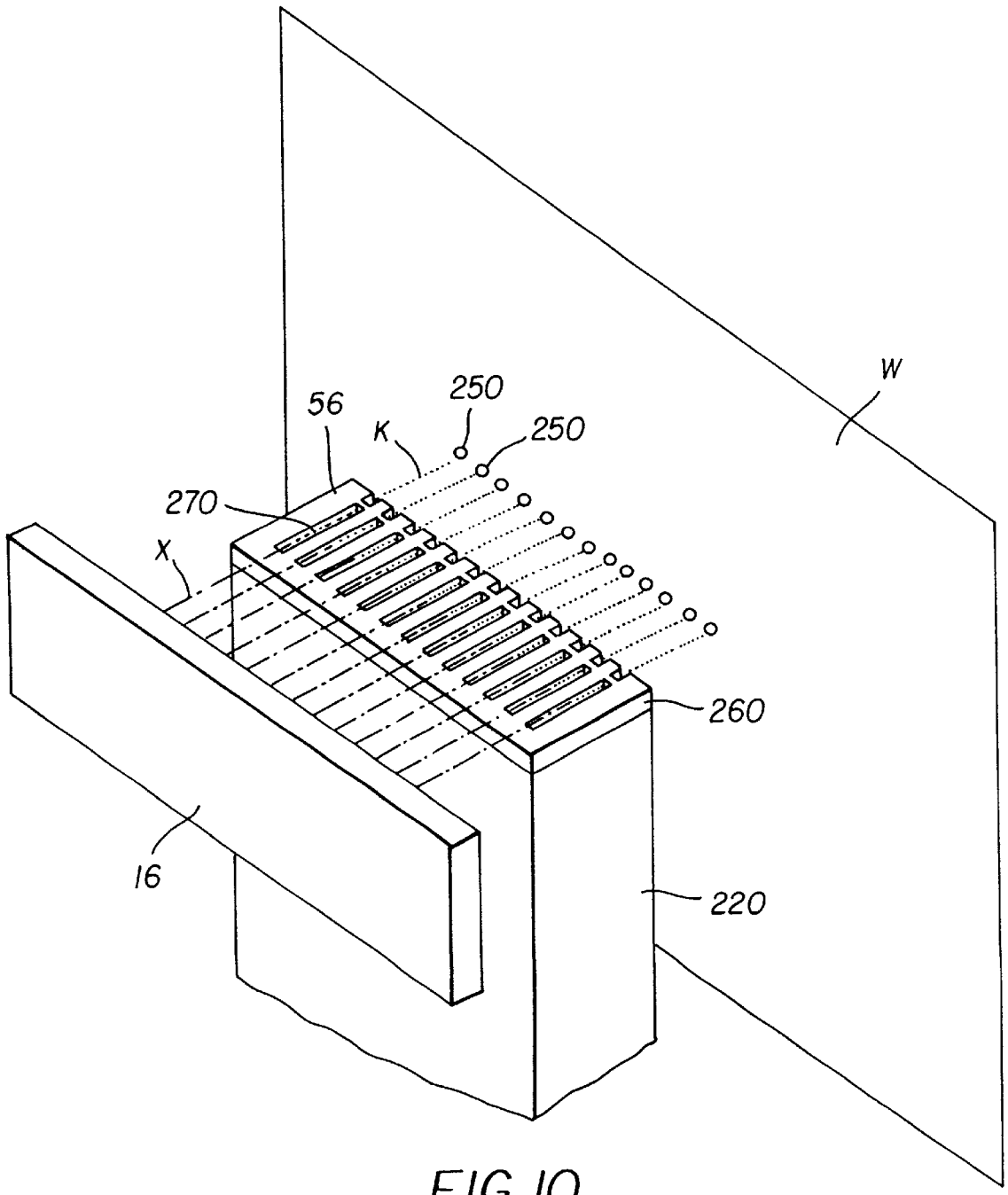
FIG. 10 is an isometric view of the printhead assembly as droplet streams are emitted according to the present invention.

An overall view of a printhead assembly using this embodiment is given in FIG. 10. As droplet streams are emitted from printhead 16, they pass over droplet deflector system 56. Small ink droplets 100 are deflected from initial path X, and are drawn into plenum 220. Large droplets 95 are only slightly deflected onto path K which clears the guttering elements of vacuum aperture plate 260, and the droplets then strike print media W at locations 250.

Figure 11:
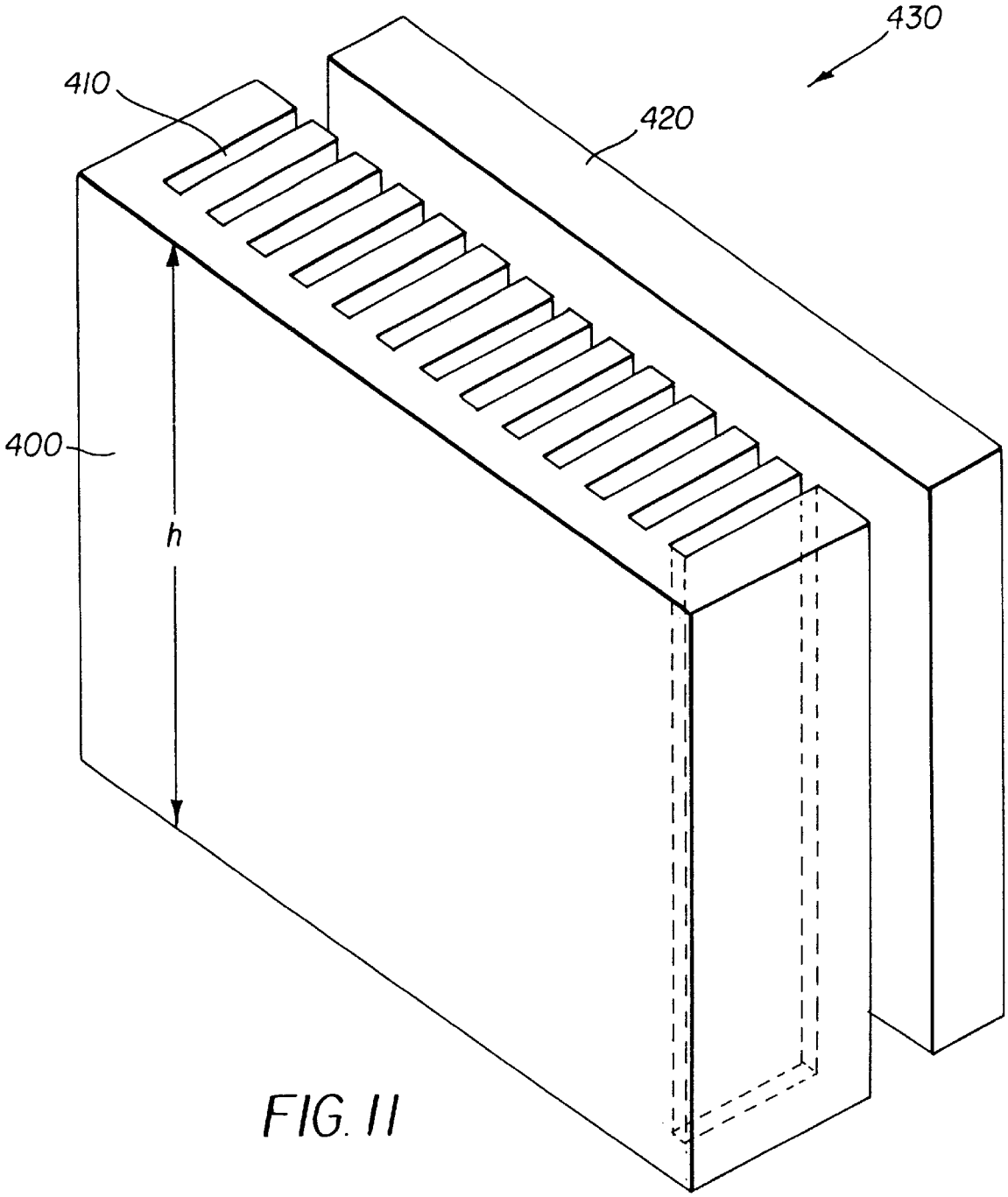
FIG. 11 shows an alternate embodiment of the present invention.

An alternate embodiment of this invention for the design of a droplet deflector 430 involves the formation of gas-flow channels 410 in a substrate 400 as shown in FIG. 11. The substrate 400 may be ceramic, metal, plastic, etc. however, silicon is preferred. A cover plate 420 is adhesively bonded to substrate 400, thereby forming one side of the gas-flow channels 410. As in the previous embodiment, there is a one-to-one correspondence between gas-flow channels 410 and individual jets (not shown) on the printhead 16. A manifold (not shown) couples a gas source (or vacuum) into the gas-flow channels 410. An advantage of this embodiment is that the droplet deflector system 56 is a more mechanically durable structure, however, the structure is more expensive due to increased silicon consumption.

Figure 12:
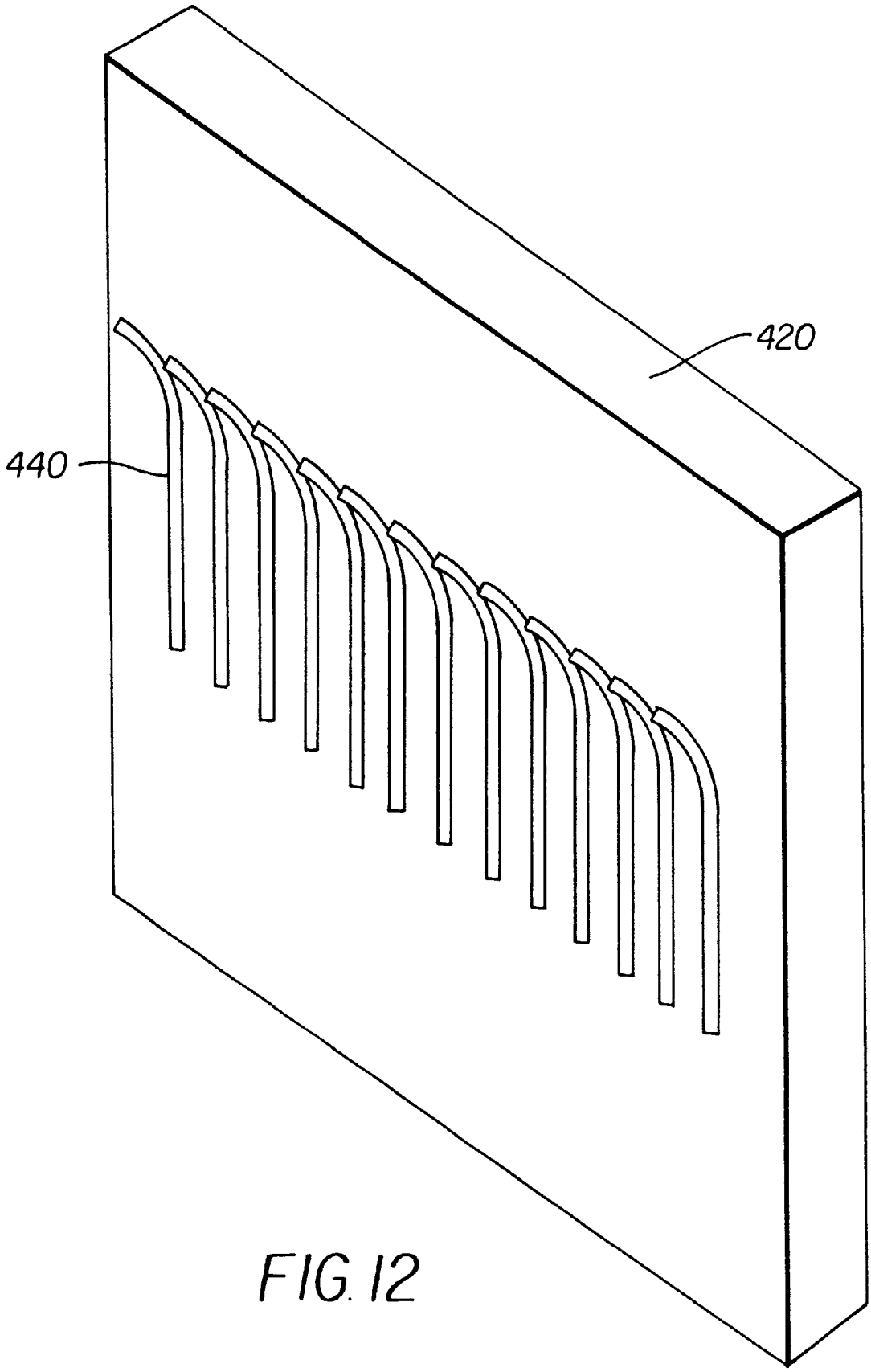
FIG. 12 shows still another embodiment of the present invention.

A modification of droplet deflector 430 is envisioned wherein cover plate 420 is manufactured with plural thermal-bend-actuators 440 disposed on the surface as shown in FIG. 12. The thermal-bend-actuators may be formed from a bi-layer of TiAl and SiN, for example. They are positioned such that when cover plate 420 is bonded to substrate 400, there is a thermal-bend-actuator in each of the gas-flow channels 410. In the rest or non-activated state, the thermal-bend-actuators lie flat against cover plate 420, and thus do not impede gas flow in gas -flow channels 410. When the thermal-bend-actuators 440 experience resistive heating due to the passage of electrical current as directed by micro-controller 24, they bend away from cover plate 420 and restrict gas flow. Generally, larger electrical currents produce larger actuator bending, so that the gas flow may be individually regulated in each gas-flow channel 410. This control of gas flow allows the deflection of each individual jet on the printhead to be balanced for optimum operation.

While the foregoing description includes many details and specificities, it is to be understood that these have been included for purposes of explanation only, and are not to be interpreted as limitations of the present invention. Many modifications to the embodiments described above can be made without departing from the spirit and scope of the invention, as is intended to be encompassed by the following claims and their legal equivalents.

PARTS LIST

| | |
|---|---|
| 5 | continuous inkjet printer system |
| 10 | image source |
| 12 | image processing unit |
| 13 | image memory |
| 14 | heater control circuit |
| 16 | printhead |
| 18 | recording medium |
| 20 | recording medium transport system |
| 22 | recording medium transport control system |
| 24 | micro-controller |
| 26 | ink pressure regulator |
| 28 | ink reservoir |
| 30 | ink channel |
| 32 | heater |
| 34 | ink gutter |
| 36 | ink recycling unit |
| 38 | droplet forming mechanism |
| 40 | heater |
| 42 | nozzle bore |
| 44 | resistive heating element |
| 46 | contact pad |
| 48 | conductor |
| 56 | droplet deflector system |
| 58 | gas flow source |
| 62 | filament of working fluid |
| 65 | electrical pulse time |
| 70 | electrical pulse time |
| 75 | electrical pulse time |
| 80 | delay time |
| 83 | delay time |
| 84 | delay time |
| 85 | delay time |
| 90 | delay time |
| 95 | large non-printable droplets |
| 100 | small printable droplets |
| 105 | large non-printable droplets |
| 110 | large non-printable droplets |
| 130 | gas flow discriminator |
| 200 | exit aperture plate |
| 210 | exit slits |
| 220 | plenum |
| 240 | ink guttering structure |
| 250 | location of print media |
| 260 | vacuum aperture plate |

-continued

PARTS LIST

| | |
|---|---|
| 270 | slots |
| 280 | guttering ribs |
| 290 | relief channel |
| 300 | bonding wafer |
| 310 | bonding wafer |
| 400 | substrate |
| 410 | gas-flow channels |
| 420 | cover plate |
| 430 | droplet deflector |
| 440 | thermal-bend-actuators |

What is claimed is:

1. An inkjet printhead, comprising:

a) a plurality of nozzle bores from which streams of ink droplets having selectable first and second volumes are emitted;

b) a droplet deflector for deflecting the ink droplets having first and second volumes into first and second paths respectively, the droplet deflector producing a corresponding plurality of physically separate streams of gas, each stream of gas directed on a corresponding one of the streams of ink droplets; and c) an ink gutter positioned to catch the ink droplets moving along one of the first or second paths.

2. The inkjet printhead as claimed in claim 1, wherein the streams of gas are provided by individual jets as defined by a plurality of slits in a plate structure such that a gas flow discriminator is formed.

3. The inkjet printhead as claimed in claim 1, wherein the streams of gas are positive from a pressure source above ambient.

4. The inkjet printhead as claimed in claim 1, wherein the streams of gas are negative from a pressure source below ambient.

5. The inkjet printhead as claimed in claim 1, wherein actuators are provided in said droplet deflector, such that the streams of gas are independently adjustable for each of the streams of ink droplets.

6. The inkjet printhead as claimed in claim 1, wherein the streams of gas are applied in a direction substantially perpendicular to one of the first or second paths of ink droplets.

7. The inkjet printhead as claimed in claim 1, wherein one of the first or second paths of ink droplets includes a gutter path.

8. The inkjet printhead as claimed in claim 1, wherein one of the first or second paths of ink droplets includes a printing path.

9. The inkjet printhead as claimed in claim 2, wherein the plate structure includes slits spaced equivalent to the plurality of nozzle bores.

10. The inkjet printhead as claimed in claim 2, wherein the plate structure includes a plenum that draws one of the first and second volumes of streams of ink droplets into the plenum.

11. The inkjet printhead as claimed in claim 5, wherein the actuators respond to resistive heating from the passage of an electrical current.

12. An inkjet printhead, comprising:

a) one or more nozzle bores from which a stream of ink droplets of adjustable volumes are emitted;

b) at least one heater associated with each of the nozzle bores and adapted to independently adjust the volume of the emitted ink droplets, wherein the emitted ink droplets, categorically, are within a first or a second range of unequal volumes c) a droplet deflector adapted to produce a force on the emitted ink droplets, wherein the force is applied to the emitted ink droplets at an angle with respect to the stream of ink droplets to cause the emitted ink droplets having the first range of volumes to move along a first path, and the emitted ink droplets having the second range of volumes to move along a second path;

d) a structure integrated with the droplet deflector to provide a physically separate gas flow for each of the stream of ink droplets;

e) a micro-controller adapted to adjust the emitted ink droplets having the first and second range of volumes corresponding to either a first or second operational state, respectively; and f) an ink gutter positioned to allow the emitted ink droplets having the first range of volumes moving along the first path to move unobstructed past the ink gutter, while intercepting the emitted ink droplets having the second range of volumes moving along the second path.

13. The inkjet printhead claimed in claim 12, wherein the physically separate gas flow for each of the stream of ink droplets are operable due to thermal heating.

14. The inkjet printhead claimed in claim 12, wherein the physically separate gas flow for each of the stream of ink droplets are provided by individual jets as defined by a plurality of slits in a plate structure such that a gas flow discriminator is formed.

15. The inkjet printhead claimed in claim 12, wherein the physically separate gas flow for each of the stream of ink droplets are positive from a pressure source above ambient.

16. The inkjet printhead claimed in claim 12, wherein the physically separate gas flow for each of the stream of ink droplets are negative from a pressure source below ambient.

17. The inkjet printhead claimed in claim 12, wherein actuators are provided in the droplet deflector, such that the physically separate gas flow for each of the stream of ink droplets are independently adjustable for each of the streams of ink droplets.

18. The inkjet printhead claimed in claim 12, wherein the physically separate gas flow for each of the stream of ink droplets are applied in a direction substantially perpendicular to either or both of the first or second paths.

19. The inkjet printhead claimed in claim 12, wherein either or both of the first or second paths includes a gutter path.

20. The inkjet printhead claimed in claim 12, wherein either or both of the first or second paths includes a printing path.

21. The inkjet printhead claimed in claim 14, wherein the plate structure includes slits spaced equivalent to the one or more nozzle bores.

22. The inkjet printhead claimed in claim 14, wherein the plate structure includes a plenum that draws one of the first or second volumes of streams of ink droplets into the plenum.

23. The inkjet printhead claimed in claim 17, wherein the actuators respond to resistive heating from the passage of an electrical current.

24. A method for selectively controlling ink droplets in an inkjet printhead, comprising the steps of:

a) emitting streams of ink droplets having selectable first and second volumes;

b) deflecting the ink droplets having first and second volumes into first and second paths, respectively;

c) providing a plurality of separate streams of gas;

d) directing each of the plurality of separate streams of gas at a corresponding one of the streams of ink droplets to move the streams of ink droplets along the first and second paths; and e) catching the ink droplets moving along one of the first or second paths in an ink gutter.

25. The method claimed in claim 24, further comprising the steps of:

f) independently adjusting the plurality of separate streams of gas according to each of the streams of ink droplets; and g) directing the plurality of separate streams of gas substantially perpendicular to one of the first or second paths.

26. The method claimed in claim 24, wherein one of the first or second paths includes a gutter path.

27. The method claimed in claim 24, wherein one of the first or second paths includes a printing path.

28. The method claimed in claim 24, wherein the plurality of separate streams of gas are positive from a pressure source above ambient.

29. The method claimed in claim 24, wherein the plurality of separate streams of gas are negative from a pressure source below ambient.

* * * * *